US007398742B1

(12) United States Patent
Gonring

(10) Patent No.: US 7,398,742 B1
(45) Date of Patent: Jul. 15, 2008

(54) METHOD FOR ASSISTING A STEERING SYSTEM WITH THE USE OF DIFFERENTIAL THRUSTS

(75) Inventor: Steven J. Gonring, Slinger, WI (US)

(73) Assignee: Brunswick Corporation, Lake Forest, IL (US)

( * ) Notice: Subject to any disclaimer, the term of this patent is extended or adjusted under 35 U.S.C. 154(b) by 104 days.

(21) Appl. No.: 11/448,185

(22) Filed: Jun. 7, 2006

(51) Int. Cl.

| | |
|---|---|
| ***B63H 25/04*** | (2006.01) |
| ***B63H 25/10*** | (2006.01) |
| ***G05D 1/02*** | (2006.01) |
| *B63H 25/44* | (2006.01) |
| *B63H 5/20* | (2006.01) |
| *B63H 5/125* | (2006.01) |
| *B63H 20/08* | (2006.01) |

(52) U.S. Cl. ..... 114/144 R; 114/144 A; 440/53

(58) Field of Classification Search ..... 114/144 R, 114/144 A; 440/37–43, 53; 701/21
See application file for complete search history.

(56) References Cited

U.S. PATENT DOCUMENTS

| | | | | |
|---|---|---|---|---|
| 4,519,335 | A * | 5/1985 | Krautkremer et al. | 114/144 R |
| 4,632,049 | A * | 12/1986 | Hall et al. | 114/150 |
| 6,174,210 | B1 | 1/2001 | Spade et al. | 440/41 |
| 6,234,853 | B1 * | 5/2001 | Lanyi et al. | 440/53 |
| 6,273,771 | B1 * | 8/2001 | Buckley et al. | 440/84 |
| 6,405,669 | B2 | 6/2002 | Rheault et al. | 114/144 R |
| 6,428,371 | B1 | 8/2002 | Michel et al. | 440/38 |
| 6,524,146 | B2 | 2/2003 | Spade et al. | 440/41 |
| 6,561,860 | B2 | 5/2003 | Colyvas | 440/61 |
| 6,997,763 | B2 | 2/2006 | Kaji | 440/1 |
| 7,267,068 | B2 * | 9/2007 | Bradley et al. | 114/144 R |

* cited by examiner

*Primary Examiner*—Lars A Olson
*Assistant Examiner*—Daniel V Venne
(74) *Attorney, Agent, or Firm*—William D. Lanyi

(57) ABSTRACT

A steering assist system provides differential thrusts by two or more marine propulsion devices in order to create a more effective turning moment on a marine vessel. The differential thrusts can be selected as a function of the magnitude of turn commanded by an operator of the marine vessel and, in addition, as a function of the speed of the marine vessel at the time when the turning command is received.

9 Claims, 5 Drawing Sheets

METHOD FOR ASSISTING A STEERING SYSTEM WITH THE USE OF DIFFERENTIAL THRUSTS

BACKGROUND OF THE INVENTION

1. Field of the Invention

The present invention generally relates to a steering assist system and, more particularly, to a method for assisting the steering of a marine vessel which has two or more marine propulsion devices.

2. Description of the Related Art

Various techniques have been used in the past to assist the steering of a marine vessel or watercraft through the control of the thrust generated by a marine propulsion device associated with the marine vessel or watercraft. In addition, it is generally known that the manipulation of the trim tabs of a marine vessel can assist is in vessel control and, in certain applications, in the steering system of a marine vessel or watercraft.

U.S. Pat. No. 6,174,210, which issued to Spade et al. on Jan. 16, 2001, describes a watercraft control mechanism comprising a steerable propulsion source, a steering controller for controlling the steerable propulsion source, a linking member connected to the steerable propulsion source, and at least one tab connected to the linking member. The tab is movable between an inoperative position and an operative position whereby the tab can be angled such that, in the operative position and when the watercraft is traveling upright in water in a substantially forward direction, a volume of water impinges on a top surface of the tab, thereby creating a downward and rearward force on the watercraft.

U.S. Pat. No. 6,405,669, which issued to Rheault et al. on Jun. 18, 2002, describes a watercraft with steer response engine speed controller. The control system provides thrust for steering control in a watercraft that is powered by a propulsion unit. The steering control system is applicable to various types of watercraft, including boats and personal watercraft, that are powered by inboard jet propulsion systems or outboard engines. The system is activated by the steering helm assembly and/or an electronic control mechanism.

U.S. Pat. No. 6,428,371, which issued to Michel et al. on Aug. 6, 2002, describes a watercraft with steer responsive engine speed controller. The controller generates thrust when the steerable propulsion unit is turned beyond a predetermined angular threshold. Turning the steering wheel beyond the threshold causes the speed controller to increase engine speed so that the propulsion unit produces thrust at least equal to the minimal propulsive force needed to effectively steer the watercraft.

U.S. Pat. No. 6,524,146, which issued to Spade et al. on Feb. 25, 2003, describes a watercraft having auxiliary steering. A control mechanism for a watercraft includes a selectively movable flap connected to an actuator, which moves the flap into and out of the flow of water to affect steering, deceleration and trimming. The flap is recessed with respect to the lower surface of the hull so that it does not create drag at high speeds. The flap may be a portion of the ride plate, may be disposed in a recess in the bottom of the hull, or may be disposed on the stern above the bottom of the hull.

U.S. Pat. No. 6,561,860, which issued to Colyvas on May 13, 2003, describes a maneuvering enhancer for twin outboard motor boats. An adjustable length bar is used to replace a rigid bar, the one connecting the two outboards or the two outdrives of a boat, for steering purposes, said adjustable bar being electrically operated through a switch on the boat's dashboard, said switch having two operating positions, one to keep propellers creating two parallel thrusts, and a second to shift the propellers to create a vee configuration, by which the boat's maneuverability will be enhanced.

U.S. Pat. No. 6,997,763, which issued to Kaji on Feb. 14, 2006, describes a running control device. A running control device for a watercraft controls propulsion force and tilt angle of a propulsion device relative to the hull of the watercraft. The running control device also sets an optimum trim angle automatically. The running control device includes a propulsion force control section that controls the propulsion force of the propulsion device. The running control device also includes a tilt angle control section that controls the tilt angle of the propulsion device. A target propulsion force calculation module responds to first input information to calculate a target propulsion force. An amount-of-operation calculation module responds to second input information to calculate an amount of operation of the propulsion device to produce the target propulsion force. The tilt angle control section includes a tilt angle calculation module that determines the tilt angle based on the propulsion force.

The patents described above are hereby expressly incorporated by reference in the description of the present invention.

SUMMARY OF THE INVENTION

A method for controlling a marine propulsion system of a marine vessel, in accordance with a preferred embodiment of the present invention, comprises the steps of providing a first marine propulsion device attached to the marine vessel and configured to provide a first thrust on the marine vessel. It also comprises the step of providing a second marine propulsion device attached to the marine vessel and configured to provide a second thrust on the marine vessel. The method further comprises the steps of sensing an occurrence of a steering movement associated with the marine vessel, causing the first and second marine propulsion devices to be aligned with their first and second thrusts being generally parallel to each other, and affecting the relative thrusts of the first and second marine propulsion devices as a function of the steering movement.

In a particularly preferred embodiment of the present invention, the steering movement is a rotation of a steering wheel of the marine vessel and the first and second marine propulsion devices are located on the port and starboard side, respectively, of the marine vessel. The affecting step causes the first thrust to be relatively larger in magnitude than the second thrust when the steering movement is associated with a turn of the marine vessel toward starboard. In certain embodiments of the present invention, the first and second thrust are both in a direction to propel the marine vessel in a forward direction. However, it should also be understood that the first and second thrusts can be in opposite directions. The affecting step can increase one of the first and second thrusts and decrease the other of the first and second thrusts. The average magnitude of the first and second thrusts, after the affecting step is performed, is generally equal to the average magnitude of the first and second thrusts before the affecting step is performed.

A preferred embodiment of the present invention can further comprise the steps of providing a plurality of trim tabs attached to the marine vessel and changing the positions of the trim tabs as a function of the steering movement. In a preferred embodiment of the present invention, it can further comprise the steps of measuring a magnitude of the steering movement and causing the first and second thrusts to differ by a differential magnitude which is selected as a function of the magnitude of the steering movement. The differential magnitude, in a particularly preferred embodiment of the present invention, is a non-linear function of the magnitude of the steering movement.

BRIEF DESCRIPTION OF THE DRAWINGS

The present invention will be more fully and completely understood from a reading of the description of the preferred embodiment in conjunction with the drawings, in which.

DESCRIPTION OF THE PREFERRED EMBODIMENT

Figure 1:
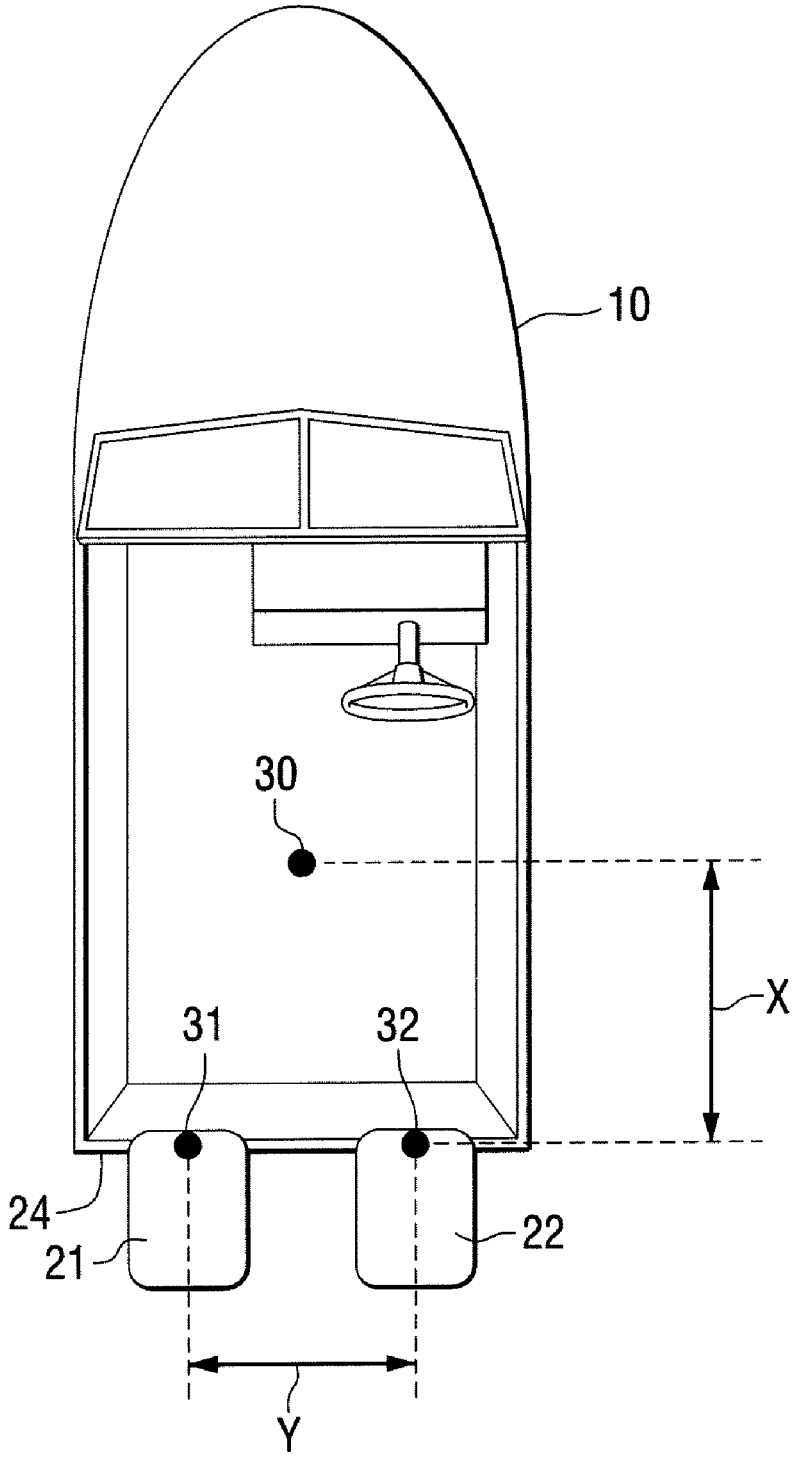
FIG. 1 is a schematic illustration of a marine vessel with first and second marine propulsion devices.

Throughout the description of the preferred embodiment of the present invention, like components will be identified by like reference numerals.

FIG. 1 is a schematic representation of a marine vessel 10 with two marine propulsion devices, 21 and 22, attached to its transom 24. An effective center of gravity 30 is shown at a distance X from the transom 24. In addition, the attachment points, 31 and 32, of the first and second marine propulsion devices, 21 and 22, are illustrated as being separated by a dimension Y. The steering axes of the first and second marine propulsion devices, 21 and 22, are located at the attachment points, 31 and 32, respectively. The marine vessel 10 is maneuvered by causing the first and second marine propulsion devices to rotate about their respective steering axes.

Figure 2:
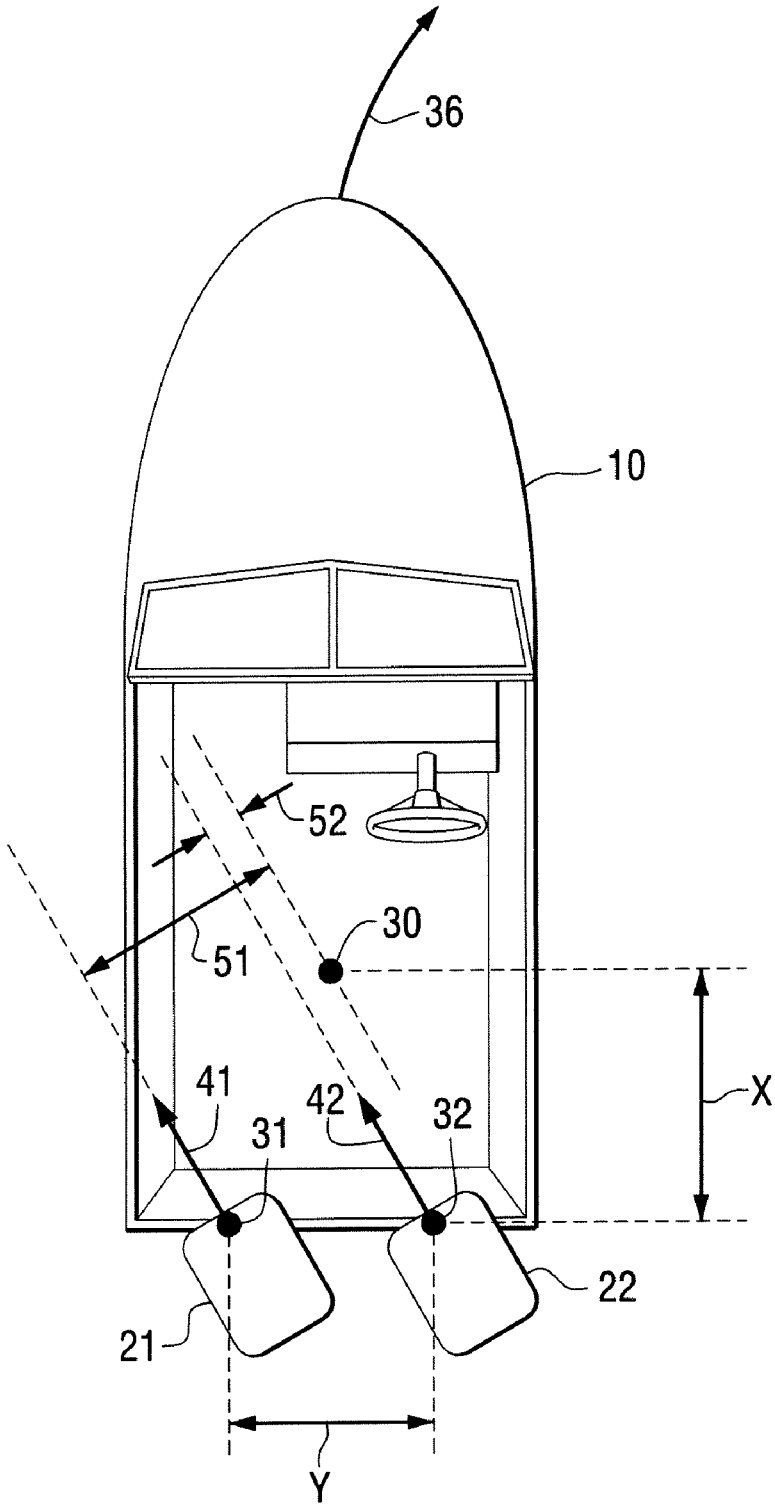
FIG. 2 is similar to FIG. 1, but with the marine propulsion devices rotated about their respective steering axes.

FIG. 2 is a schematic representation of the marine vessel 10 when it is being turned toward starboard as represented by arrow 36. The first and second marine propulsion devices are rotated about their respective steering axes, 31 and 32, in response to an operator's manipulation of a steering wheel of the marine vessel 10. The turning moment exerted on the marine vessel 10 results from the first thrust 41 of the first marine propulsion device creating a first moment about the effective center of gravity 30 which is equivalent to the first thrust 41 multiplied by a first moment arm 51 as shown in FIG. 2. In addition, the total moment affecting the turning of the marine vessel 10 includes a second moment which is equivalent to a second thrust 42 multiplied by a second moment arm 52. The magnitudes of the first and second moment arms, 51 and 52, can be calculated mathematically as a function of the dimensions identified as X and Y in FIGS. 1 and 2.

With continued reference to FIG. 2, it can be seen that the first thrust 41 has a greater effect on the total turning moment than the second thrust 42 because of its larger moment arm 51 compared to the smaller moment arm 52. The turning procedure can be improved significantly if the first thrust 41 is increased relative to the second thrust 42. In other words, while maintaining the same combined thrust on the marine vessel 10, the magnitudes of the two thrusts can be redistributed to improve the turning efficiency of the marine vessel 10. If the first thrust 41 is increased and the second thrust 42 is decreased, by equivalent magnitudes, the total thrust on the marine vessel 10 will remain essentially the same, but the turning moment will be increased significantly because the increased first thrust 41 operates with moment arm 51 which is larger than the second moment arm 52.

Figure 3:
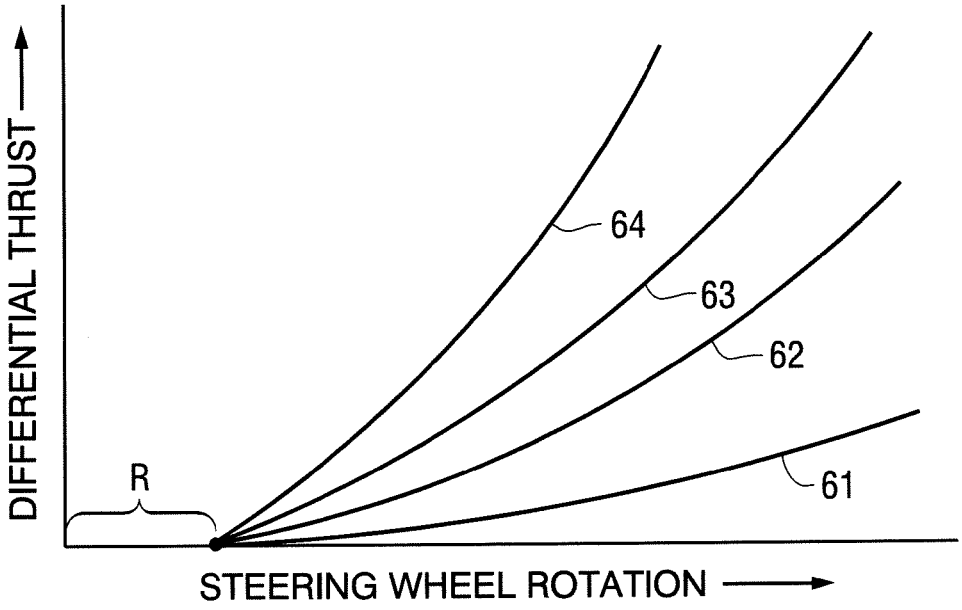
FIG. 3 is a graphical representation of the relationship between the differential thrusts provided by the present invention and steering wheel rotation.

FIG. 3 is a graphical representation of the relationship between the amount of differential thrust created between the first and second thrusts, 41 and 42 in FIG. 2, as a function of the amount of rotation of a steering wheel of the marine vessel 10 or other steering device. The horizontal axis in FIG. 3 represents the degrees of rotation of the steering wheel. In particularly preferred embodiments of the present invention, a first amount of rotation represented by R in FIG. 3, is intended to occur without any changes in the relative thrusts from the first and second marine propulsion devices, 21 and 22 in FIGS. 1 and 2. As an example, perhaps the first ten degrees of rotation of the steering wheel is allowed to occur before any alteration of the first and second thrusts is accomplished. Then, based on the speed of the marine vessel 10, a differential magnitude is added to the first marine propulsion device 21 and subtracted from the second marine propulsion device 22. This can be accomplished by changing the engine operating speed of the first and second marine propulsion devices. The family of curves in FIG. 3 represents different differential thrust modifications that are based on different marine vessel speeds. For example, if the marine vessel is traveling at a relatively high speed, the relationship represented by line 61 would be used. A slower speed would indicate the use of the relationship represented by line 62. Line 63 represents the relationship for yet a slower speed and line 64 would represent the relationship between steering wheel rotation and differential thrusts for the slowest of the four illustrated speeds. Typically, the slowest operating speed represented by line 64 would apply to conditions such as docking when the marine vessel 10 is moving at a very slow speed and additional steering assistance is particularly helpful. The vertical axis in FIG. 3 represents a differential thrust between the first and second thrusts, 41 and 42 in FIG. 2, and can be a percentage increase and decrease of these thrusts or an equivalent offset magnitude of the two engine operating speeds.

Figure 4:
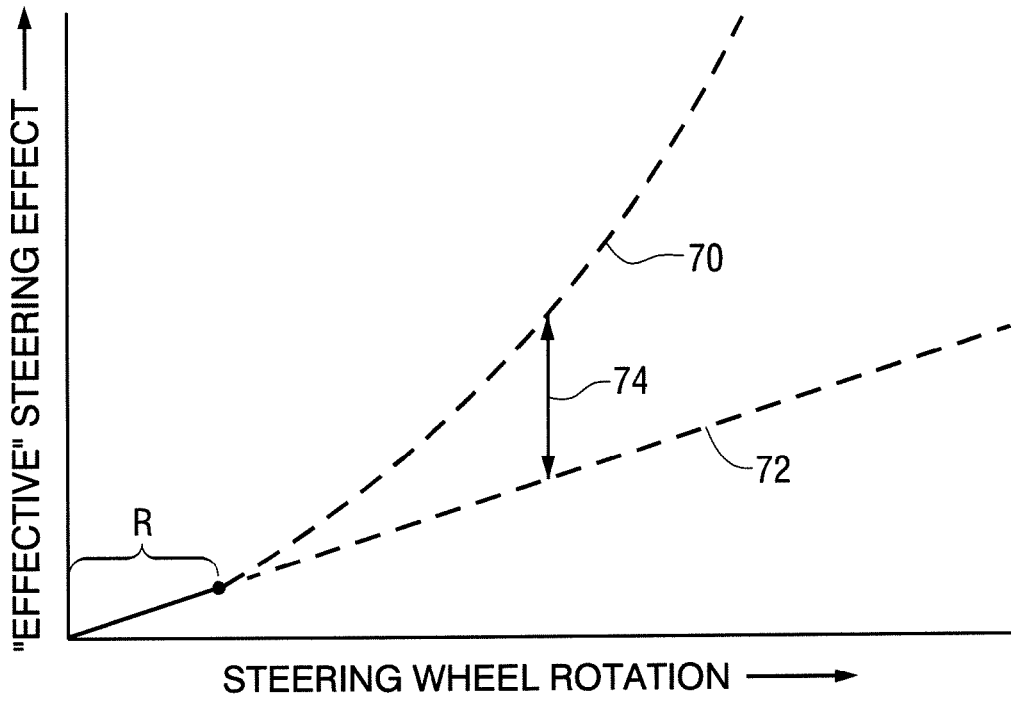
FIG. 4 is a schematic hybrid representation showing the effect on the steering caused by the implementation of the present invention.

FIG. 4 is a hybrid graphical representation showing the affective steering effect on the marine vessel 10 as a function of the steering wheel rotation position. Only one of the family of curves, 61-64 from FIG. 3, is represented in FIG. 4. After the steering wheel has rotated by an angular rotation represented by R in FIG. 4, the differential thrust is introduced to the first and second marine propulsion devices to create an increased steering effect which is represented by dashed line 70. This dashed line 70 is the result of the addition of the normal steering effect caused by rotation of the steering wheel and rotation of the marine propulsion devices about their steering axes and the additional improvement in the steering moment on the vessel 10 caused by the creation of the differential thrusts. Dashed line 72 represents the normal steering effect that would be caused by the steering wheel rotation alone. Arrow 74 represents the additional benefit caused by the creation of the differential thrusts, rather than equal thrusts, and dashed line 70 represents the sum of these two effects.

Figure 5:
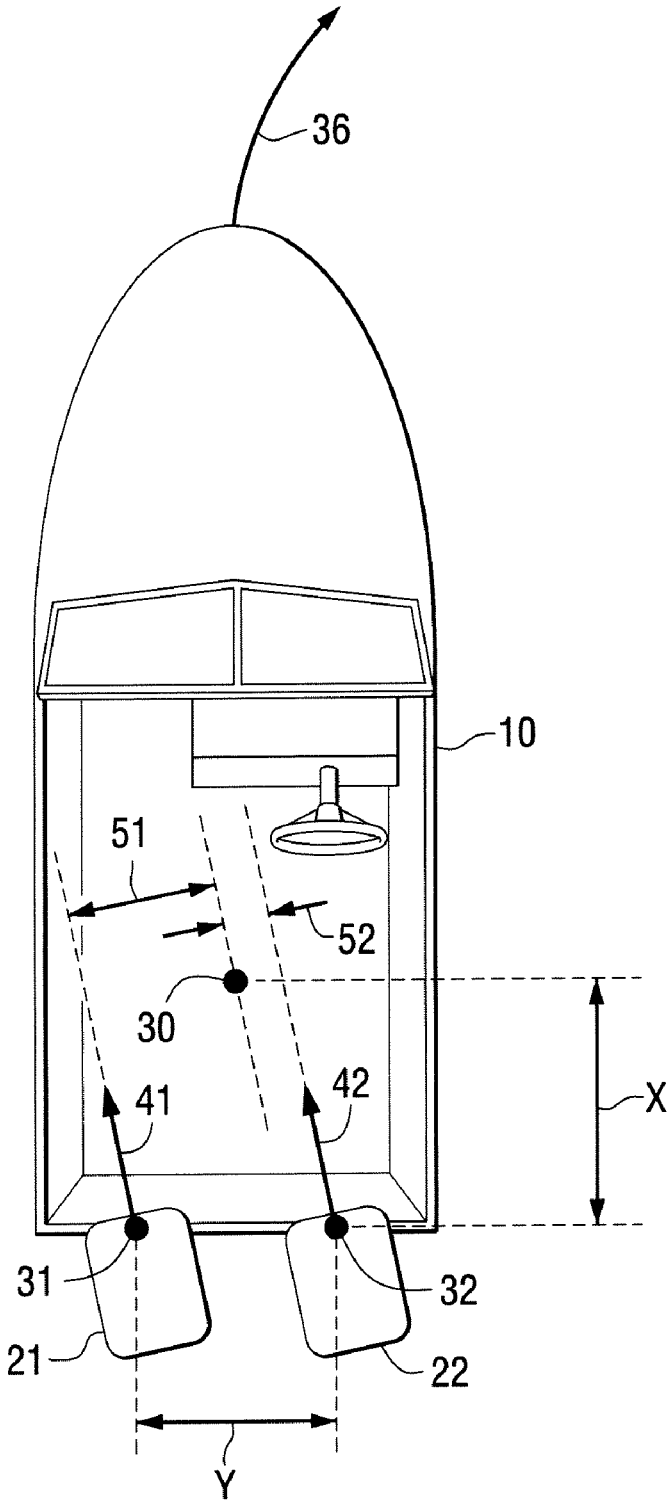
FIG. 5 is an illustration similar to FIGS. 1 and 2, but with the marine propulsion devices turned at a different angle.

FIG. 2 illustrates the relationship between the first and second thrusts, 41 and 42, and the effective center of gravity 30 when the first and second marine propulsion devices, 21 and 22, are rotated sufficiently to cause both thrusts to act about the effective center of gravity 30 in the same rotational direction. In other words, the first and second thrusts, 41 and 42, in FIG. 2 both are directed in a way that creates a clockwise rotation of the marine vessel 10 about the effective center of gravity 30. FIG. 5 is intended to illustrate a condition in which the two marine propulsion devices, 21 and 22, direct their thrusts on opposites of the effective center of gravity 30 so that they are creating moments in opposite directions. For example, the first thrust 41 operates with the first moment arm 51 to create a clockwise moment on the vessel 10 about its effective center of gravity 30. However, the second thrust 42 of the second marine propulsion device 22 operates in conjunction with moment arm 52 to create a counterclockwise moment on the vessel 10 about its effective center of gravity 30. In the situation shown in FIG. 5, an increase in the first thrust 41 and a corresponding decrease in the second thrust 42 will have the beneficial effect of increasing the moment in a clockwise direction and decreasing the moment in a counterclockwise direction that would otherwise be created by the second thrust 42.

With reference to FIGS. 2 and 5, it can be seen that the present invention provides a benefit in both illustrated situations. If both the first and second thrusts, 41 and 42, are operating to create moments in the desired direction as illustrated in FIG. 2, an increase in the first thrust 41 which operates with a larger moment arm 51 and a corresponding decrease in the second thrust 42, in order to maintain a constant total thrust, is beneficial because a larger turning moment results. As illustrated in FIG. 5, the increase in the first thrust 41 increases the turning moment and a decrease in the second thrust 42 decreases a moment in the direction opposite to that which is desired. Therefore, both situations illustrate that the present invention is beneficial in the improvement of the turning efficiency and effectiveness. In both situations, the same turning angle of the first and second marine propulsion devices, 21 and 22, will result in a tighter turning radius and increases steering moment when the differential thrust procedure is implemented.

Figure 6:
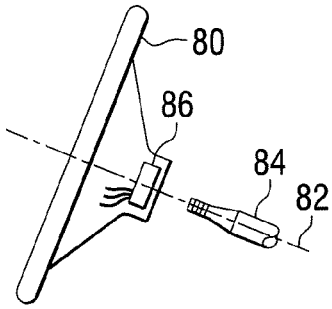
FIG. 6 is a simplified representation of a steering wheel of a marine vessel.

FIG. 6 illustrates a steering wheel 80 which is rotatable about an axis 82 of a steering wheel shaft 84. A potentiometer 86 is illustrated in FIG. 6 and is used to determine the rotational position of the steering wheel 80. In other words, as the operator of the marine vessel rotates the steering wheel 80 to affect a turning of the marine vessel, the potentiometer 86 senses the degree of turn and provides that information to a microprocessor associated with the overall control of the marine vessel. Although a potentiometer 86 is used in this example, it should be understood that many other types of sensors are available for this purpose and are well known to those skilled in the art. The vessel can be equipped with push-pull cables that rotate the first and second marine propulsion devices about their steering axes in response to rotation of the steering wheel 80. Alternatively, a steer-by-wire system can use actuators that are rotated in response to commands received by a microprocessor which, in turn, receives signals representing the position of the steering wheel 80 from the potentiometer 86. The present invention can be used in both a mechanical system, which uses push-pull cables, or a drive-by-wire system. In addition, hydraulic systems are available for use in conjunction with both manual steering systems and drive-by-wire systems. The method used to rotate the marine propulsion devices about their respective steering axes is not limiting to the present invention.

With continued reference to FIG. 6, some typical steering systems that are very well known to those skilled in the art, are configured to cause the marine propulsion devices to rotate by a magnitude of approximately thirty degrees in either the clockwise or counterclockwise direction relative to the positions of the marine propulsion devices shown in FIG. 1. This plus and minus thirty degree rotation of the marine propulsion devices about their steering axes, 31 and 32, conforms to a rotation of the steering wheel 80 two and one-half turns about its axis 82. In other words, nine hundred degrees of rotation of the steering wheel 80 results in thirty degrees of rotation of the associated marine propulsion device. However, it should be understood that this configuration is offered as an example and that alternative configurations are also possible.

Figure 7A:
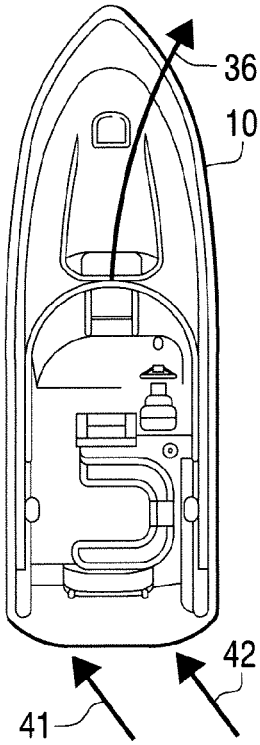
FIGS. 7A-7C show various effects on a marine vessel by different changes in the differential thrusts of two marine propulsion devices.
Figure 7B:
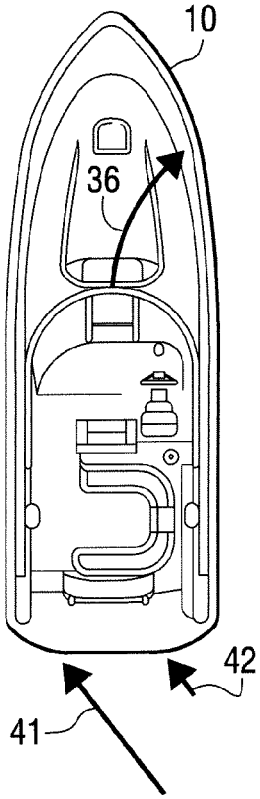
Figure 7C:
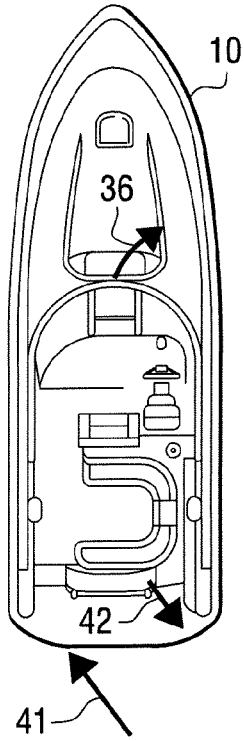

FIGS. 7A-7C show a marine vessel 10 in three situations that are all within the scope of the present invention. In the illustrations of FIGS. 7A-7C, the marine propulsion devices are sterndrive systems which are not visible in the illustrations. However, the basic principles of the present invention apply equally to sterndrive systems and outboard motor systems. In FIG. 7A, the steering effect 36 is accomplished by turning the marine propulsion devices to direct their first and second thrusts, 41 and 42, as illustrated. The first and second thrusts in FIG. 7A are equal to each other. In FIG. 7B, the same turning angle is accomplished, but the first thrust 41 is increased and the second thrust 42 is decreased. The length of the arrows in FIG. 7B are intended to show that the first thrust 41 is increased by the same magnitude that is used to decrease the second thrust 42. This results in an improved turning effect 36. In FIG. 7C, the second thrust 42 is actually reversed. This results in the turning effect 36 illustrated in FIG. 7C. The illustrations shown in FIGS. 7A-7C all result in a turn toward starboard of the marine vessel 10, but show different techniques which accomplish this turn in different ways. In addition, the effectiveness of the turns toward starboard are different in the three examples.

Figure 8:
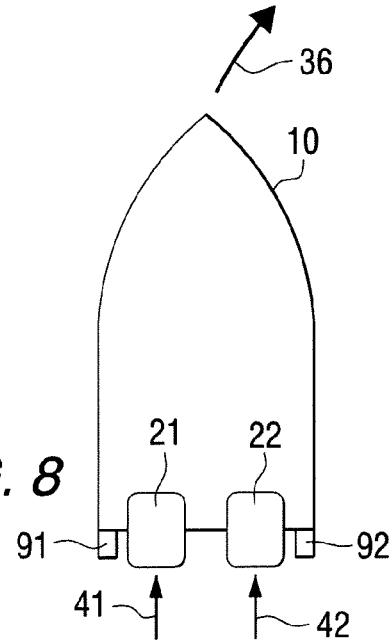
FIG. 8 is a simplified schematic representation of a marine vessel with trim tabs.

FIG. 8 is a simplified schematic representation of the marine vessel 10 and the first and second marine propulsion devices, 21 and 22, with their respective first and second thrusts, 41 and 42. In addition, first and second trim tabs, 91 and 92, are illustrated. In certain embodiments of the present invention, the trim tabs are used to further assist in the turning effect.

With continued reference to FIGS. 1-8, it can be seen that a method for controlling a marine propulsion system of a marine vessel, in a preferred embodiment, comprises the steps of providing a first marine propulsion device 21 attached to the marine vessel 10 and configured to provide a first thrust 41 on the marine vessel, providing a second marine propulsion device 22 attached to the marine vessel 10 and configured to provide a second thrust 42 on the marine vessel, sensing an occurrence of a steering movement, by a potentiometer 86 associated with a steering wheel 80, causing the first and second marine propulsion devices, 21 and 22, to be aligned so that their first and second thrusts, 41 and 42, are generally parallel to each other. This parallel relationship between the first and second thrusts, 41 and 42, can be associated with two thrusts in the same direction or two thrusts in opposite directions as long as their associated vectors are parallel to each other. The method of the present invention further comprises the step of affecting the relative thrusts of the first and second marine propulsion devices, 21 and 22, as a function of the rotational movement of the steering wheel 80. In the example described above, the first marine propulsion device 21 is located on the port side of the marine vessel 10 and second marine propulsion device 22 is located on the starboard side of the marine vessel 10. The affecting step causes the first thrust 41 to be relatively larger in magnitude than the second thrust 42 when the steering movement is associated with a turn of the marine vessel 10 toward starboard. The first and second thrust, 41 and 42, can be both in a direction which propels the marine vessel in a forward direction. Alternatively, the two thrusts can be in opposite directions as illustrated in FIG. 7C. The affecting step can increase one of the first and second thrusts, 41 and 42, while decreasing the other of the first and second thrusts. In a particularly preferred embodiment of the present invention, the average magnitude of the first and second thrusts, 41 and 42, after the affecting step is performed is generally equal to the average magnitude of the first and second thrusts before the affecting step is performed. In other words, each of the two thrusts is changed by a similar magnitude, but in an opposite direction of change. If one thrust is increased by ten percent, the other thrust is decreased by ten percent. Alternatively, if one thrust is increased by a certain magnitude of thrust, the other thrust is decreased by that same magnitude of thrust. The speed of the marine vessel 10 is measured and the magnitude of the selected differential thrusts is chosen as a function of the speed of the marine vessel in a particularly preferred embodiment of the present invention. At slow speeds, higher differentials are used than at high speeds. In a particularly preferred embodiment of the present invention, a plurality of trim tabs, 91 and 92, are provided and their positions are changed as a function of the steering movement of the steering wheel 80. A measured magnitude of the steering wheel movement is used to select the differential magnitudes applied to the first and second thrusts. This relationship between the differential magnitude of thrust applied to the first and second marine propulsion devices and the steering wheel movement is nonlinear in a particularly preferred embodiment of the present invention, but it should be understood that a linear relationship could also be used in alternative embodiments. The velocity of the marine vessel 10 can be measured by any appropriate technique of which many are known to those skilled in the art. Pitot tubes, GPS systems, or paddle wheel speedometers can be used to provide a magnitude of speed relating to the marine vessel. The type of speed measuring device, of which many are very well known to those skilled in the art, is not limiting to the present invention.

Although the present invention has been described with particular specificity and illustrated to show a preferred embodiment, it should be understood that alternative embodiments are also within its scope.

I claim:

1. A method for controlling a marine propulsion system of a marine vessel, comprising the steps of:

providing a first marine propulsion device attached to said marine vessel and configured to provide a first thrust on said marine vessel;

providing a second marine propulsion device attached to said marine vessel and configured to provide a second thrust on said marine vessel;

sensing an occurrence of a steering wheel movement associated with said marine vessel;

causing said first and second marine propulsion devices to be aligned, said first and second thrusts being generally parallel to each other;

varying the relative thrusts of said first and second marine propulsion devices as a result of said steering wheel movement; and measuring a speed of said marine vessel, wherein said varying step comprises the step of creating a differential thrust between said first and second marine propulsion devices which is determined as a function of said measured speed of said marine vessel, and said steering wheel rotation wherein the average magnitude of said first and second thrusts after said affecting step is performed is substantially equal to the average magnitude of said first and second thrusts before said affecting step is performed.

2. The method of claim 1, wherein:

said steering wheel movement is a rotation of a steering wheel of said marine vessel.

3. The method of claim 1, wherein:

said first marine propulsion device is located at a port side of said marine vessel; and said second marine propulsion device is located at a starboard side of said marine vessel.

4. The method of claim 3, wherein:

said affecting step causes said first thrust to be relatively larger in magnitude than said second thrust when said steering wheel movement is associated with a turn of said marine vessel toward starboard.

5. The method of claim 1, wherein:

said first and second thrusts are both in a direction to propel said marine vessel in a forward direction.

6. The method of claim 1, wherein:

said affecting step increases one of said first and second thrusts and decreases the other of said first and second thrusts.

7. The method of claim 1, further comprising:

providing a plurality of trim tabs attached to said marine vessel; and changing the positions of said trim tabs as a function of said steering wheel movement.

8. The method of claim 1, further comprising:

measuring a magnitude of said steering movement; and causing said first and second thrusts to differ by a differential magnitude which is selected as a function of said magnitude of said steering movement.

9. The method of claim 8, wherein:

said differential magnitude is a nonlinear function of said magnitude of said steering wheel movement.

* * * * *